US010717315B2

(12) United States Patent
Zimmerman et al.

(10) Patent No.: US 10,717,315 B2
(45) Date of Patent: Jul. 21, 2020

(54) HOLDER FOR WRITING INSTRUMENTS

(71) Applicants: Rachel K. Zimmerman, Saint Paul, MN (US); Dylan J. Zimmerman, Saint Paul, MN (US)

(72) Inventors: Rachel K. Zimmerman, Saint Paul, MN (US); Dylan J. Zimmerman, Saint Paul, MN (US)

( * ) Notice: Subject to any disclaimer, the term of this patent is extended or adjusted under 35 U.S.C. 154(b) by 0 days.

(21) Appl. No.: 14/212,242

(22) Filed: Mar. 14, 2014

(65) Prior Publication Data

US 2014/0263496 A1 Sep. 18, 2014

Related U.S. Application Data

(60) Provisional application No. 61/787,703, filed on Mar. 15, 2013.

(51) Int. Cl.

| | |
|---|---|
| ***B43K 23/016*** | (2006.01) |
| ***B43K 23/00*** | (2006.01) |
| ***B43L 15/00*** | (2006.01) |
| ***A44C 5/00*** | (2006.01) |
| ***A45F 5/00*** | (2006.01) |
| *A45C 11/36* | (2006.01) |

(52) U.S. Cl.

CPC ..... *B43K 23/016* (2013.01); *A44C 5/0046* (2013.01); *A45F 5/00* (2013.01); *B43K 23/00* (2013.01); *B43L 15/00* (2013.01); *A45C 11/36* (2013.01); *A45F 2005/008* (2013.01); *A45F 2200/0566* (2013.01)

(58) Field of Classification Search

CPC ..... A44C 5/0046; A44C 11/36; A45F 5/00; A45F 2005/008; A45F 2200/0566; B43K 23/016; B43K 23/00; B43L 15/00

USPC ..... 224/219–223, 267

See application file for complete search history.

(56) References Cited

U.S. PATENT DOCUMENTS

| | | | | |
|---|---|---|---|---|
| 2,793,617 | A * | 5/1957 | Palmer | B43K 23/001 224/162 |
| 5,360,342 | A * | 11/1994 | Pardner | B43K 23/001 401/88 |
| 5,437,399 | A * | 8/1995 | Levitt et al. | 224/247 |
| 5,446,953 | A * | 9/1995 | LeFeber | 24/3.2 |
| 5,722,125 | A * | 3/1998 | Vasilopoulos | A63B 60/62 150/160 |
| 6,530,131 | B1 * | 3/2003 | Hopkins | A45F 5/00 24/3.13 |
| 6,854,681 | B2 * | 2/2005 | Kish | A45F 5/004 224/162 |
| 7,563,047 | B2 * | 7/2009 | Paluda | 401/131 |
| 8,801,311 | B1 * | 8/2014 | Miller | B43K 23/02 24/298 |
| 2004/0006850 | A1 * | 1/2004 | Wax | B43K 23/002 24/10 R |
| 2004/0195121 | A1 * | 10/2004 | Jannoun | A45C 3/02 206/224 |
| 2005/0040194 | A1 * | 2/2005 | Frye et al. | 224/219 |
| 2005/0232682 | A1 * | 10/2005 | Aguirre et al. | 401/131 |

(Continued)

*Primary Examiner* — Corey N Skurdal

(74) *Attorney, Agent, or Firm* — Merchant & Gould P.C.

(57) ABSTRACT

A holder device for writing instruments, the holder device including: a main body sized to be positioned about a user's forearm; and at least one holder location coupled to the main body, the holder location being sized to hold at least one of the writing instruments.

4 Claims, 12 Drawing Sheets

(56) References Cited

U.S. PATENT DOCUMENTS

| | | | | |
|---|---|---|---|---|
| 2008/0061099 | A1* | 3/2008 | Tilby | A45C 11/00 224/666 |
| 2011/0008093 | A1* | 1/2011 | Treacy et al. | 401/131 |
| 2013/0020359 | A1* | 1/2013 | Green | 224/222 |
| 2014/0014696 | A1* | 1/2014 | Gwynn, Jr. | 224/222 |

* cited by examiner

HOLDER FOR WRITING INSTRUMENTS

BACKGROUND

Writing instruments, such as crayons and markers, are a popular form of entertainment, particularly for small children. Children enjoy creating colorful artwork, and the exercise helps with fine motor skill development and creativity. However, smaller hands sometimes have difficulty grasping the writing instruments, so it is common for one or more of the writing instruments to end up on the floor. Further, the use of multiple instruments of different colors almost assures that one or more will roll away during use. This is especially true at a restaurant in which the floor is a less-than-desirable location to retrieve the writing instruments that fall off the table.

SUMMARY

In one non-limiting aspect, an example holder device for writing instruments includes: a main body sized to be positioned about a user's forearm; and at least one holder location coupled to the main body, the holder location being sized to hold at least one of the writing instruments.

In another non-limiting aspect, an example holder device for writing instruments includes: a main body sized to be positioned about a user's forearm, wherein the main body forms a single loop and is elastic; a plurality of holder locations positioned about an outer circumference of the main body, each of the holder locations forming an opening being sized to hold at least one of the writing instruments; and a tether for each of the writing instruments, each tether including a first end coupled to the main body and a second end coupled to the respective writing instrument.

In yet another non-limiting aspect, an example method for holding a plurality of writing instruments comprises: loading the plurality of writing instruments into a holder device; placing the holder device about a forearm; removing a first writing instrument from the holder device; using the first writing instrument; and replacing the first writing instrument into the holder device.

DETAILED DESCRIPTION

The present disclosure relates generally to a device for holding writing instruments. In the examples described herein, the holder device is configured to be positioned about a user's forearm and to hold a plurality of writing instruments. The writing instruments can be removed from the holder device, used, and returned to the holder device for safekeeping. Further, the holder device can include a tether for the writing instruments so that the writing instruments are not lost. Further details about the holder device are provided below.

Referring now to FIGS. 1-11, an example holder device 110 is shown.

Figure 1:
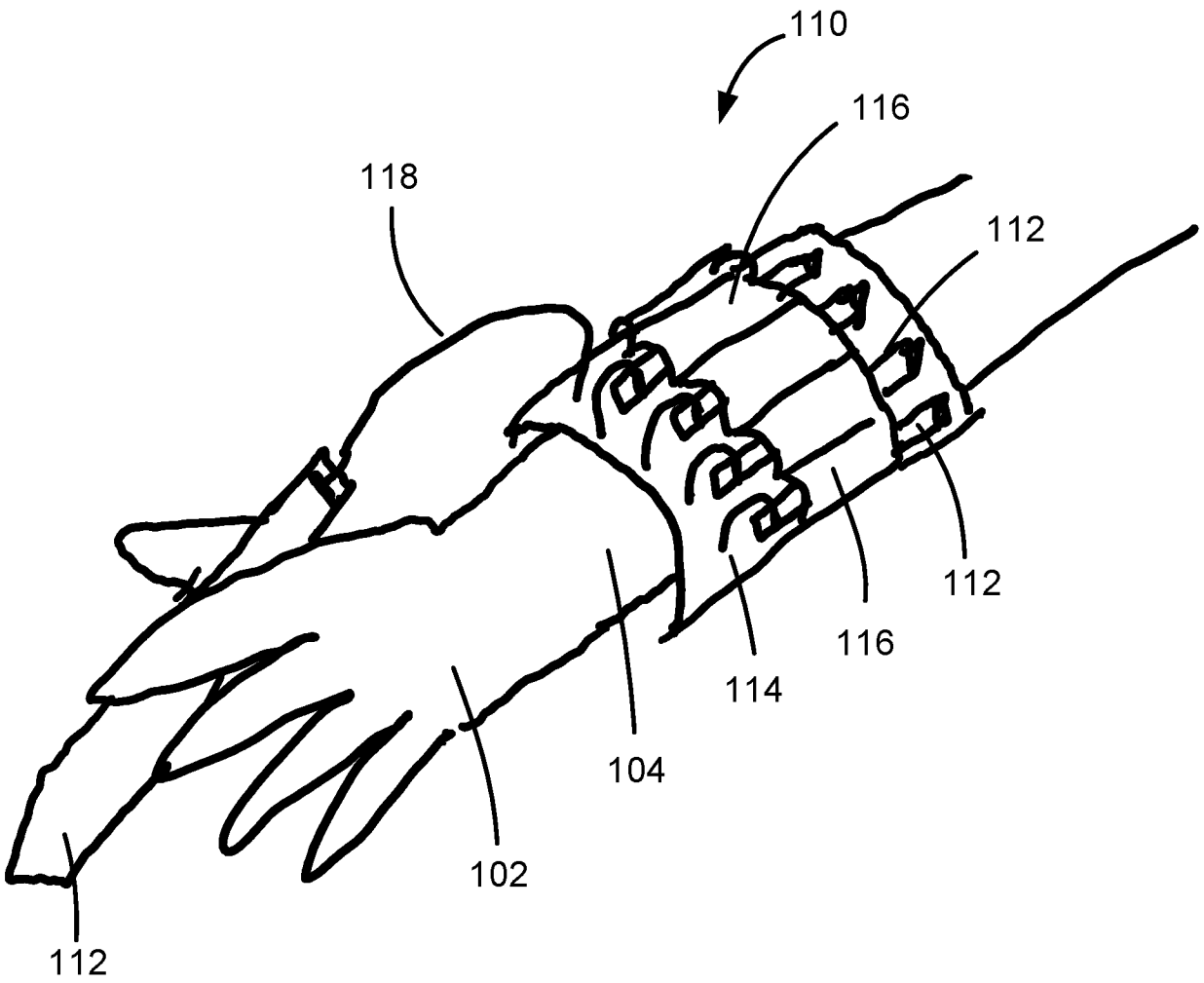
FIG. 1 is a perspective view of an example holder device as worn by a user.
Figure 2:
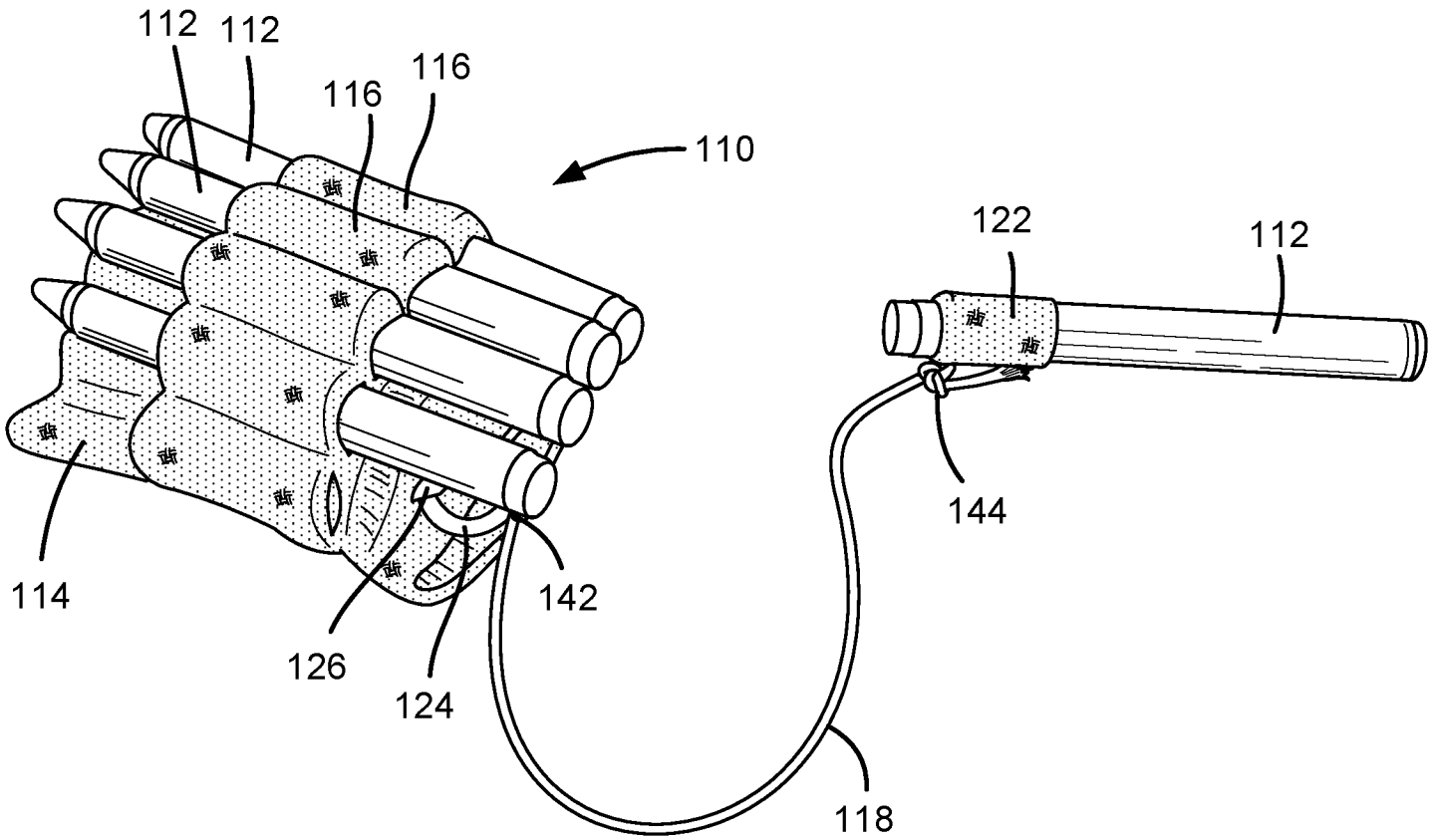
FIG. 2 is a perspective view of the holder device of FIG. 1 with one writing instrument removed therefrom.
Figure 3:
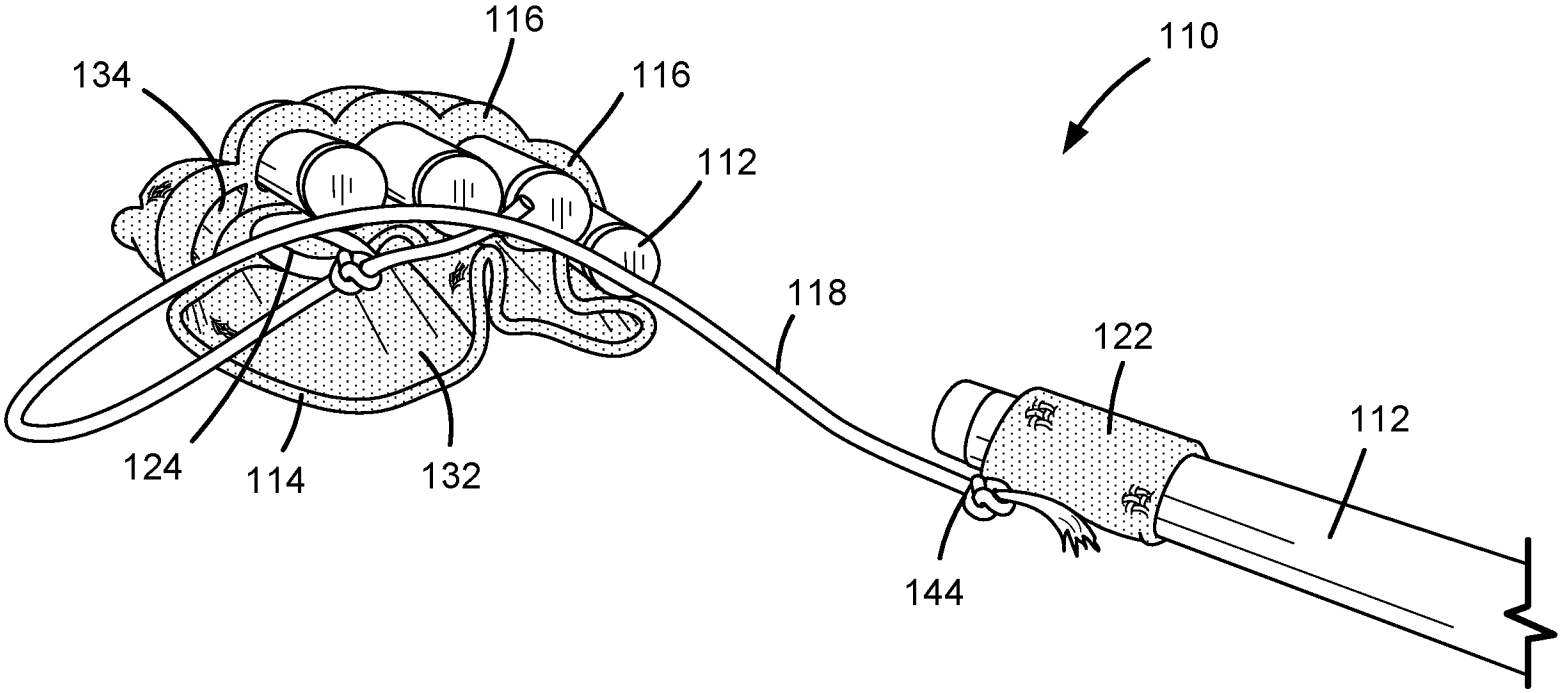
FIG. 3 is another perspective view of the holder device of FIG. 2.
Figure 4:
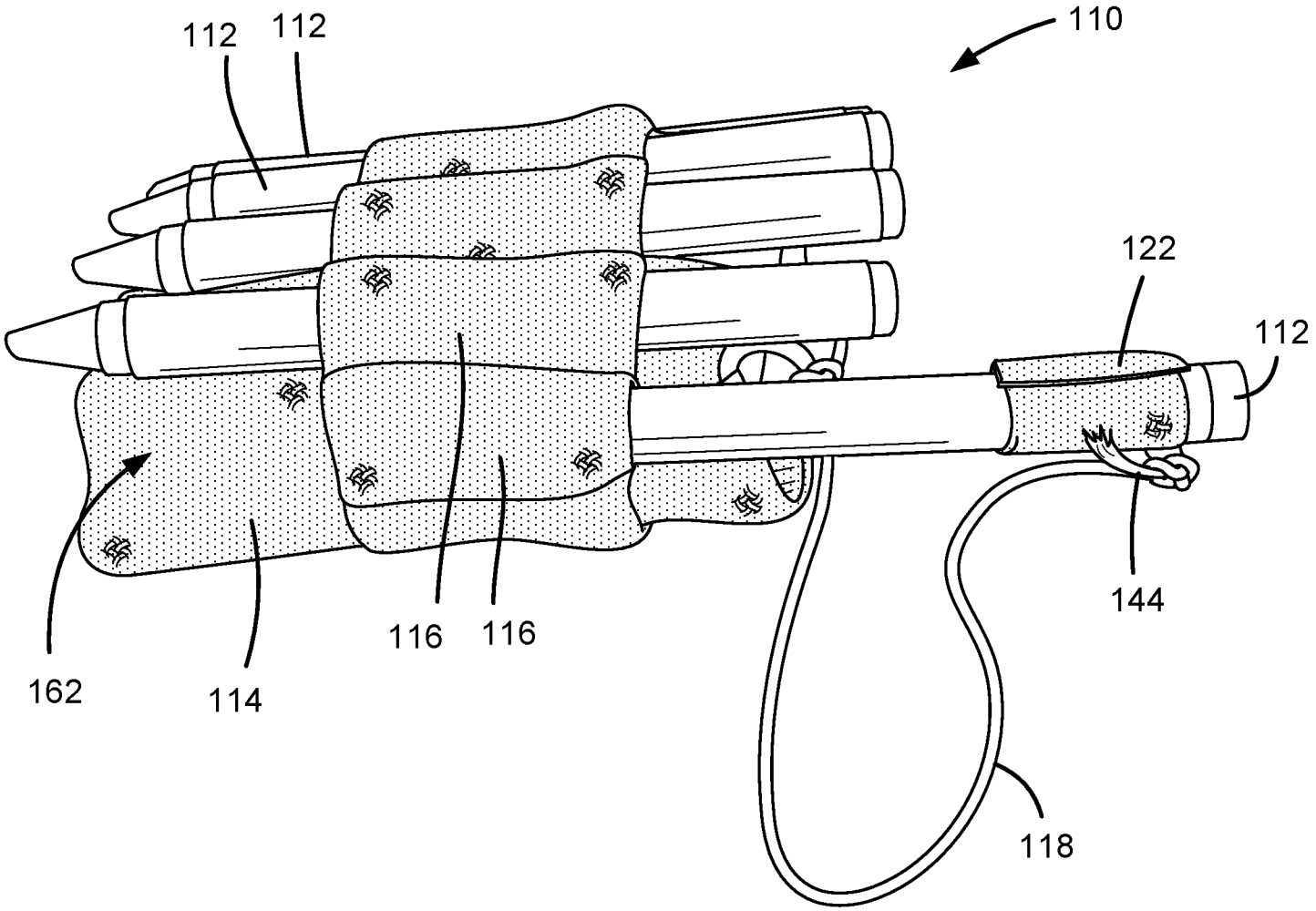
FIG. 4 is a side view of the holder device of FIG. 1 with one writing instrument partially removed therefrom.
Figure 5:
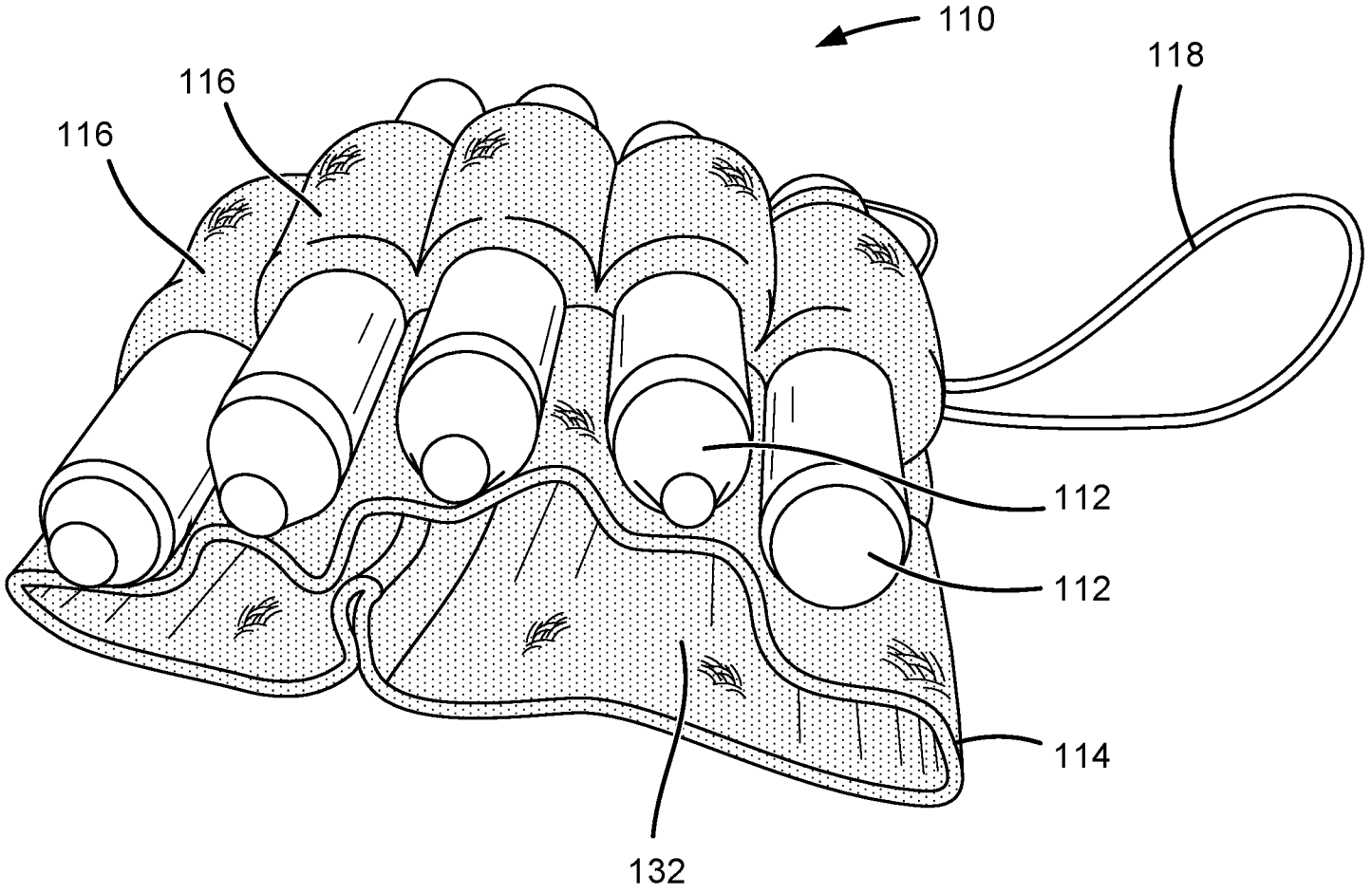
FIG. 5 is an end view of the holder device of FIG. 1.
Figure 6:
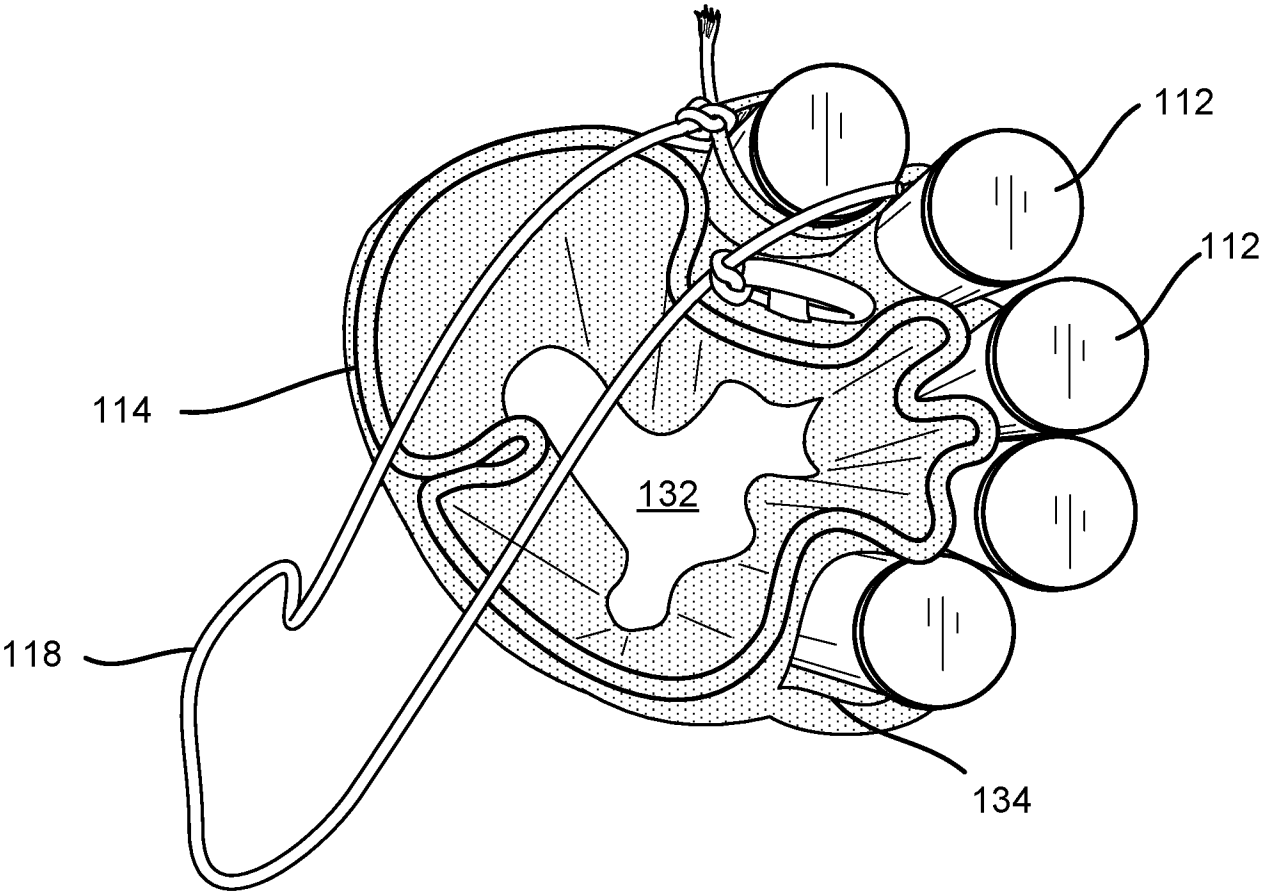
FIG. 6 is another end view of the holder device of FIG. 1.
Figure 7:
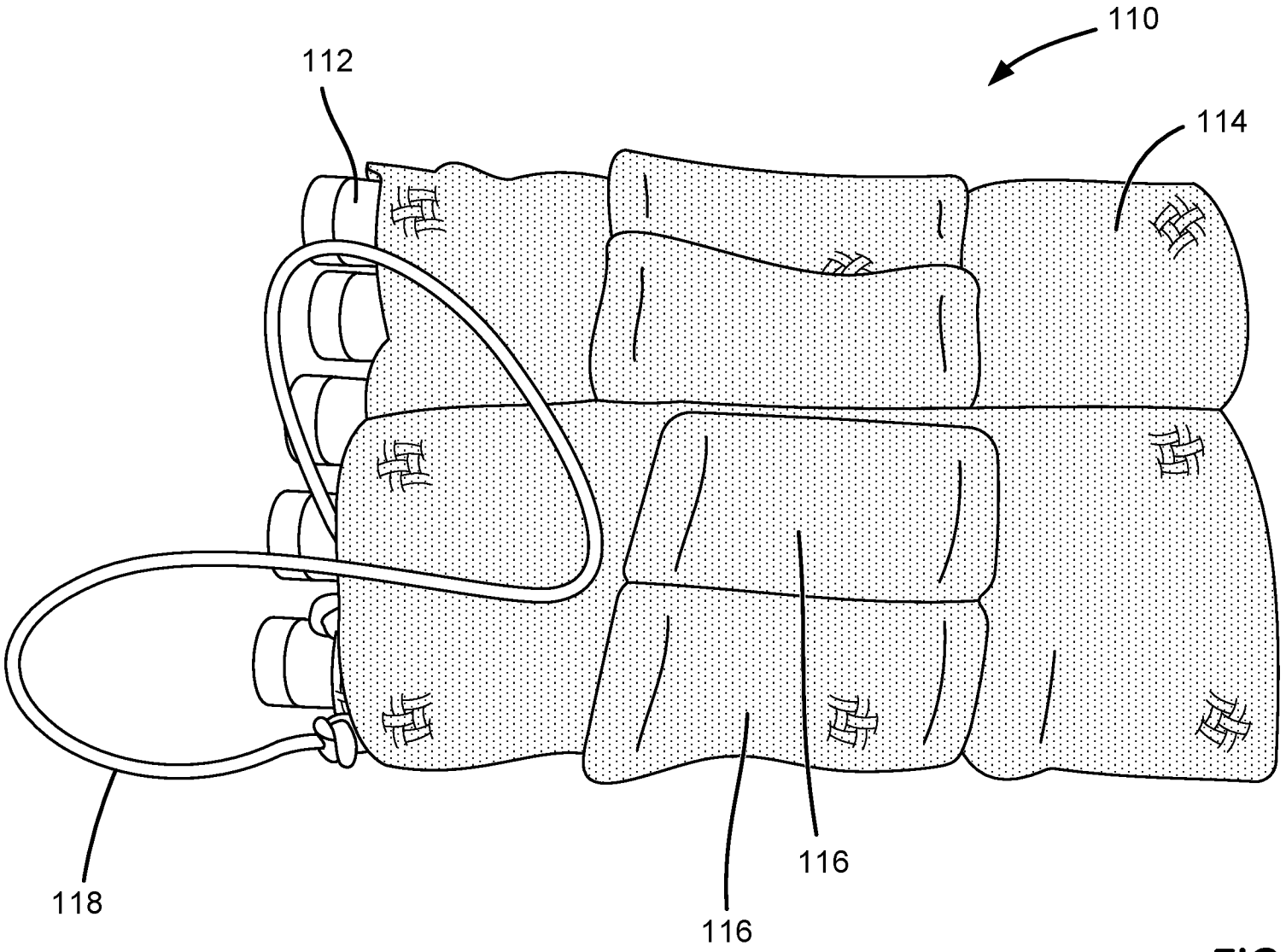
FIG. 7 is another side view of the holder device of FIG. 1.
Figure 8:
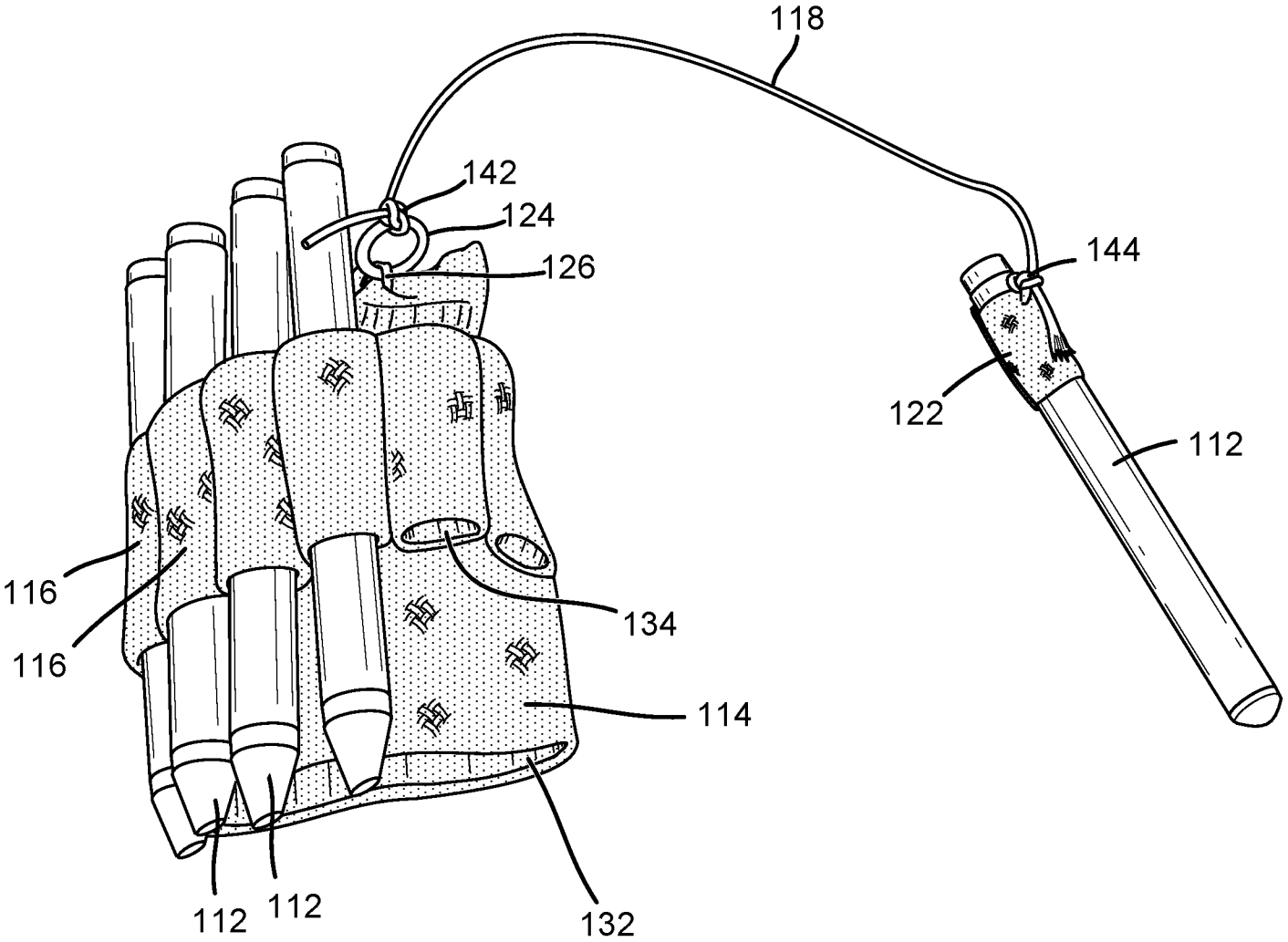
FIG. 8 is another perspective view of the holder device of FIG. 1 with one writing instrument removed therefrom.
Figure 9:
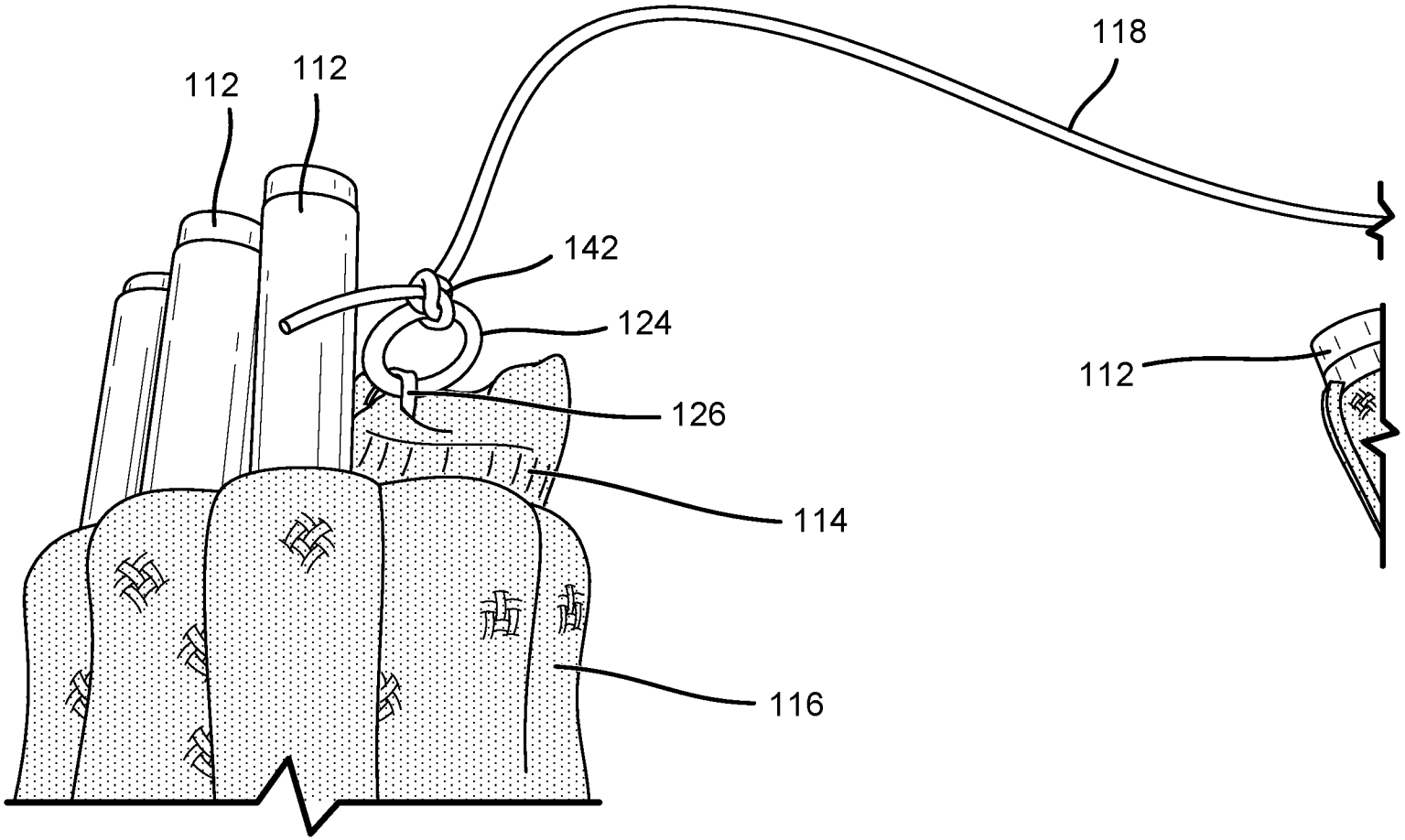
FIG. 9 is a perspective view of a portion of the holder device of FIG. 8.
Figure 10:
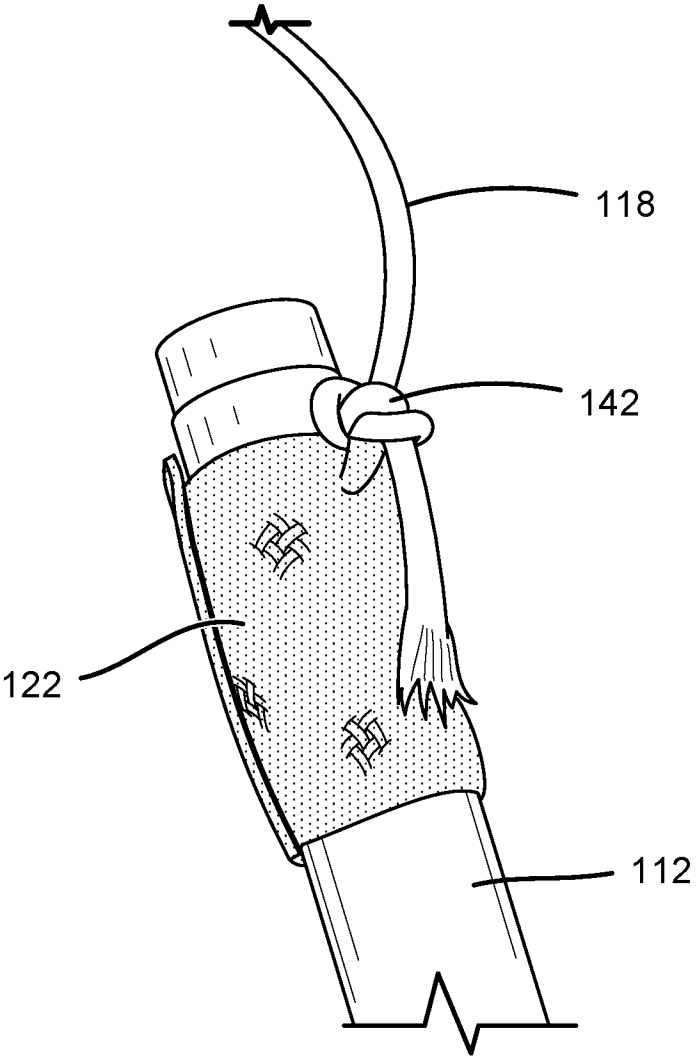
FIG. 10 is a perspective view of another portion of the holder device of FIG. 8.
Figure 11:
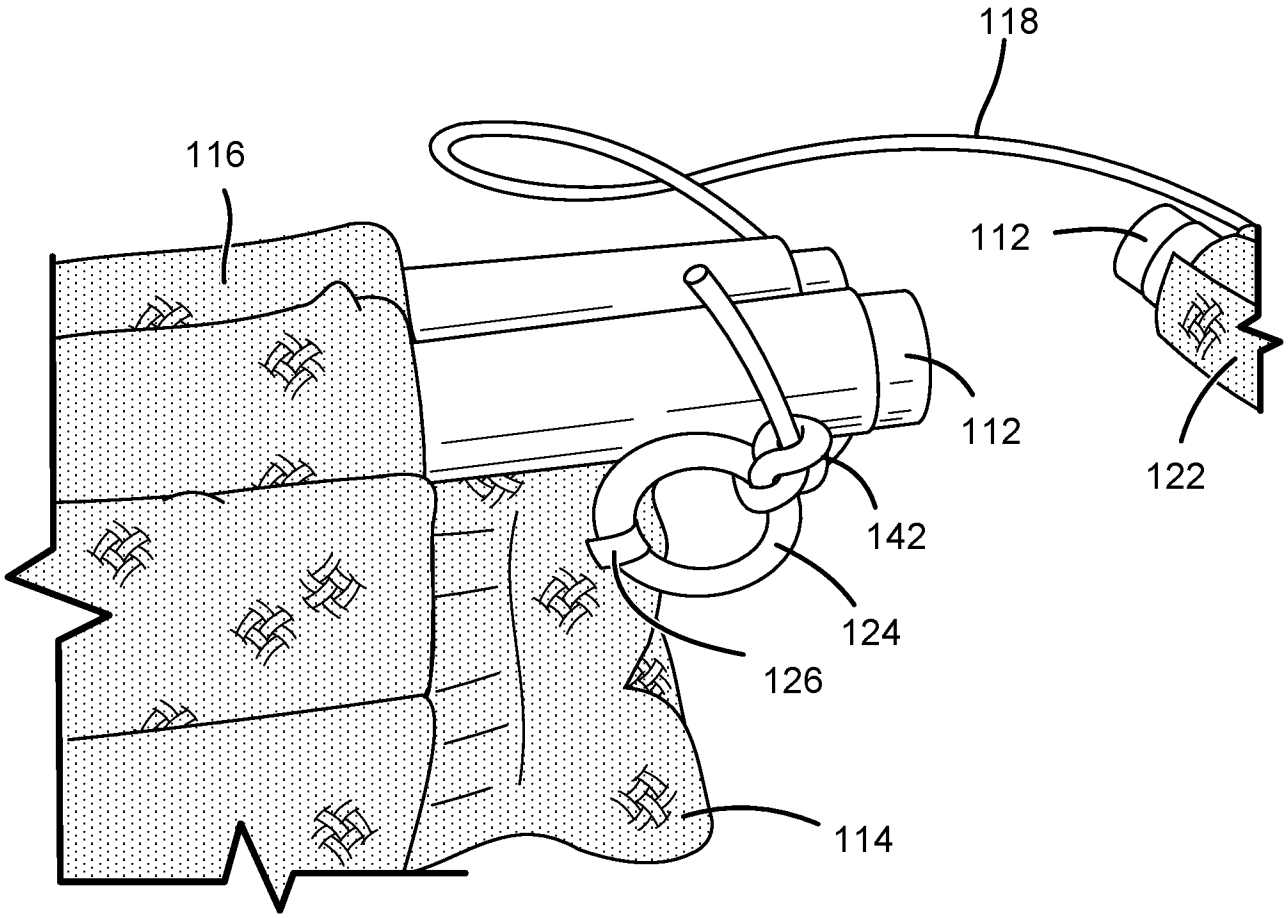
FIG. 11 is a side view of a portion of the holder device of FIG. 1.

The holder device 110 includes a main body 114. In this example, the main body 114 forms an opening 132 (see FIGS. 5-6) through which the user's hand 102 is placed so that the main body 114 is positioned on the user's wrist or forearm 104, as shown in FIG. 1.

In this example, the main body 114 is made of a single loop of a stretch fabric, such as a cotton blended with strands of elastic rubber, so that the main body 114 can be stretched to slide over the hand 102, but retracts and is held against the forearm 104 so that there is minimal slipping of the holder device 110.

In alternative embodiments, the main body 114 can be formed by a strip of material that includes an attachment mechanism so that the material can be positioned about the forearm. In this example, the attachment mechanism can be Velcro, one or more snaps, hooks, buttons, or any other suitable fastener. In yet other designs, the main body 114 can be non-elastic and allowed to slide somewhat along the forearm 104 during use. In other designs, the main body 114 includes additional material, such as cushioning or padding, on the inside portion that contacts with forearm 104 to aid in the comfort of the user. Other configurations are possible.

The holder device 110 holds one or more writing instruments 112. In the example depicted, the writing instruments 112 are crayons. However, any other type of writing instrument, such as markers, pencils, pens, etc., can be used.

Specifically, the holder device 110 includes one or more holder locations 116 positioned about the holder device 110. Preferably, the holder device 110 includes a plurality of holder locations 116 positioned about the holder device 110. Each of the holder locations 116 forms an opening 134 into which one or more of the writing instruments 112 is positioned.

In this example, the holder locations 116 are open at both ends so that the writing instruments 112 extend through the holder locations 116 and are exposed at both ends. However, in other designs, the holder locations 116 can be configured with only one opening (i.e., be closed at one end).

The holder locations 116 generally hold the writing instruments 112 when positioned therein. This can be accomplished by forming the holder locations 116 with an elastic material that stretches as the writing instruments 112 are positioned within the openings 134. Once in position, the holder location 116 "hugs" the inserted writing instrument 112 to removably maintain the writing instrument 112 within the holder location 116.

In this embodiment, the holder locations 116 are made of the same material as the main body 114. In other examples, the holder locations 116 can be made of other materials. For example, in another embodiment, the holder locations 116 can be made of a semi-rigid plastic material that engages each of the writing instruments 112 when inserted therein. In another embodiment, the holder locations 116 include features to hold the writing instruments 112, such as gel or other material included within the holder locations 116. In another embodiment, the holder locations 116 do not surround the writing instruments 112, but instead use other means, such as magnets, Velcro, snaps, or other materials to removably attach the writing instruments 112 to the holder device 110. Other configurations are possible.

When not in use, the writing instruments 112 are placed in the holder locations 116 for storage. The holder locations 116 are configured so that the writing instruments 112 can be placed in and removed therefrom with relative ease. This allows the user to successively insert and remove a plurality of the writing instruments 112 during use. For example, when creating a drawing, the user can remove and reinsert different writing instruments 112 within the different holder locations 116 as assorted colors are desired.

In this example, the holder locations 116 are generally positioned about an outer circumference 162 of the main body 114 and run generally lengthwise in a direction of the user's forearm 104. In an alternative embodiment, the holder locations 116 can be positioned at an angle (e.g., perpendicular) relative to the lengthwise direction.

The holder locations 116 are typically extended over only a portion of the outer circumference 162 of the main body 114 that can be positioned on an upper part of the forearm 104. However, in an alternative design, the holder locations 116 are positioned about substantially all or all of the circumference 162 of the main body 114.

In another alternative, multiple rows of the holder locations 116 can be positioned, one on top of another, to increase the number of writing instruments 112 that can be housed by the holder device 110. In yet a further refinement, the holder locations 116 can be increased in size (i.e., the size of the opening or openings 134 is increased) so that multiple writing instruments 112 can be placed in one holder location 116. Other configurations are possible.

In this example, one or more of the writing instruments 112 are coupled to the main body 114 of the holder device 110 by a respective tether member 118. In some examples, a tether 118 is provided for each of the writing instruments 112. In other examples, each tether member 118 connects a plurality of writing instruments 112 to the holder device 110. In other examples, less than all of writing instruments 112 are tethered.

Each of the tether members 118 includes a first end 142 that is coupled to an attachment ring 124. The attachment ring 124 is, in turn, coupled to the main body 114 by an anchor 126. The anchor 126 can be a loop sewn into the main body 114.

Likewise, a second end 144 of each of the tether members 118 is coupled to the writing instrument 112. In this example, the second end 144 is coupled to an attachment mechanism 122 that is coupled to the writing instrument 112. The attachment mechanism 122 is an elastic band that is stretched as it is placed around the writing instrument 112. When released, the elastic band retracts, thereby retaining the attachment mechanism 122 on the writing instrument 112. In another example, the attachment mechanism 122 is formed out of a rubber, gel, plastic, or other material capable of expanding to allow insertion of the writing instrument 112, and contracting once the writing instrument 112 in inserted to hold it in place during use.

In alternative designs, there are many other ways to couple the tether members 118 to the main body 114 and the writing instruments 112. For example, the first end 142 can be sewn directly onto the main body 114 and/or be formed as an integral part of the main body 114. In another example, the first end 142 can include an anchor that attaches to another feature provided on the main body 114.

Likewise, there is a multitude of ways to connect the second end 144 to the writing instruments 112. In another embodiment, the writing instruments 112 can be specifically configured with a loop or other mechanism to which the second end 144 is anchored. In another example, an adhesive can be used to couple the tether members 118 to the writing instruments 112. In another embodiment, the tether member 118 is integral with the writing instrument 112, and the tether member 118 is removably coupled to the holder device 110.

In one example, the tether members 118 are sized to allow the user to use the writing instruments 112 while the holder device 110 is worn on the forearm 104. In this example, the tether members 118 are elastic and stretch to reach the user's hand 102 when each of the writing instruments 112 is in use. In another example, the tether members 118 are simply sized to a desired length so that the writing instruments 112 can be comfortably used. In another example, the tether members 118 can be looped or coiled to decrease the amount of space taken up by the tether members 118 when the writing instruments 112 are positioned in the holder locations 116 during nonuse. In one embodiment, the tether members 118 are configured to remain out of the way and resist twisting with other tethers 118 and writing instruments 112 when in use.

The tether members 118 function to assure that the writing instruments 112 are not lost or misplaced. Should a writing instrument 112 be released by the user's hand 102, the tether member 118 assures that the writing instrument 112 is not dropped or does not roll away, since the tether member 118 limits the distance the writing instrument 112 can travel. If a writing instrument 112 is released, the writing instrument 112 is simply suspended by the tether member 118 until retrieved by the user's hand 102.

Figure 12:
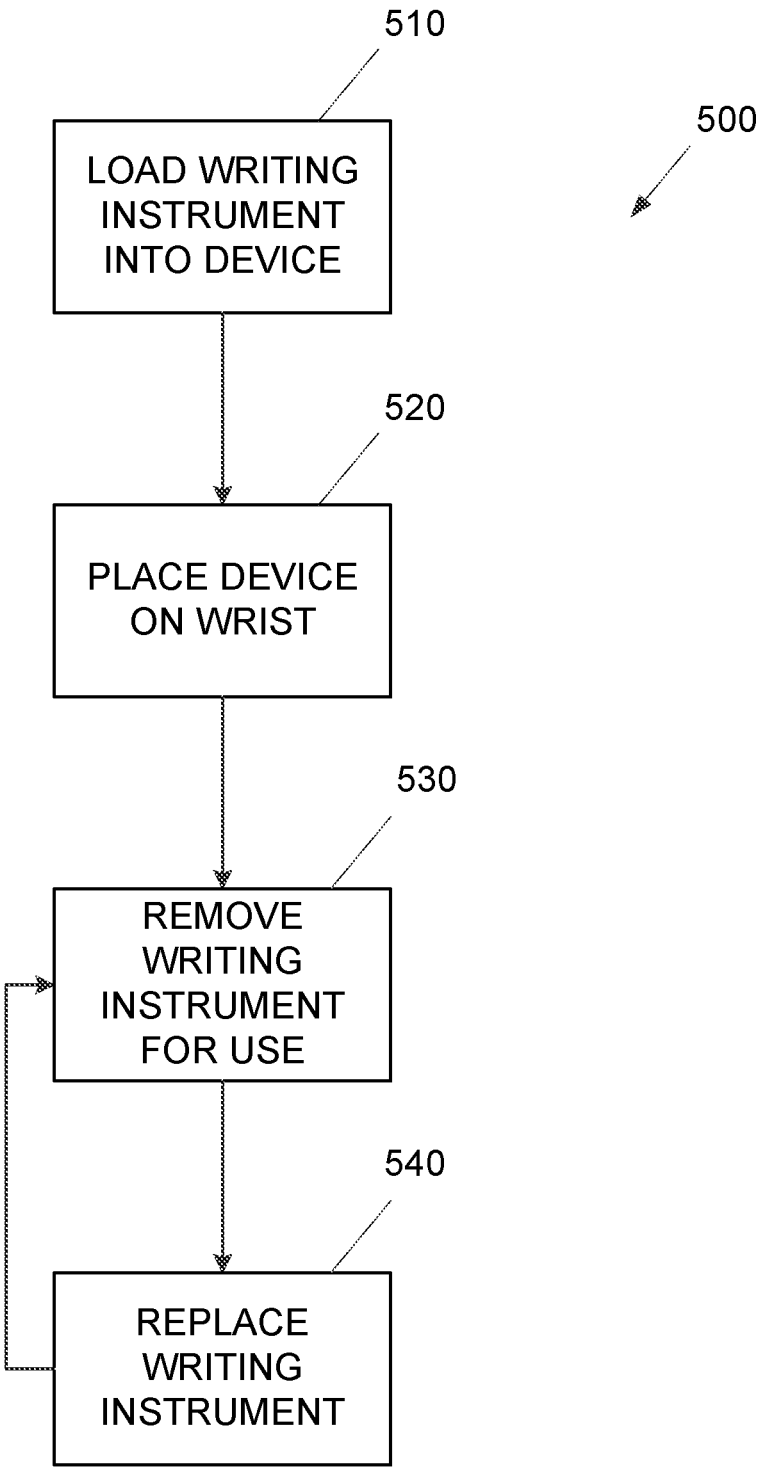
FIG. 12 is an example method of use of the holder device of FIG. 1.

Referring now to FIG. 12, an example method 500 for using the holder device 110 is shown.

Initially, at operation 510, the writing instruments are loaded into the holder device. This operation can include, for example, coupling the tethers to each of the writing instruments or to the holder device (if needed), and positioning of the writing instruments in the holder locations on the holder device.

Next, at operation 520, the holder device is placed on the wrist. If the holder device is a single loop, this is accomplished by slipping the holder device over the hand and onto the wrist. Alternatively, if the holder device is a strip, the strip is placed about the wrist and coupled thereto. In an alternative embodiment, the holder device is placed on the wrist first, and then the writing instruments are loaded.

Next, at operation 530, one of the writing instruments is removed from the respective holder location and used. For example, a color can be selected, removed from the holder device, and used for drawing.

Finally, at operation 540, the selected writing instrument can be replaced in the holder device for safekeeping. Operations 530 and 540 can be repeated as desired until the project is complete.

In the method 500, the holder device functions to keep the writing instruments organized and safeguarded. As noted, if any of the writing instruments are dropped or otherwise misplaced, the tethers assure that the writing instruments can be easily retrieved and reinserted into the holder device.

In the example shown, the user is a young person using a plurality of crayons as the writing instruments. The holder device can also be used by other individuals of varying age to manage a plurality of writing instruments. The method 500 can also be accomplished without use of the tethers.

The various embodiments described above are provided by way of illustration only and should not be construed as limiting. Various modifications and changes may be made to the example embodiments and applications illustrated or described herein or below without departing from the true spirit and scope of the disclosure.

What is claimed is:

1. A wrist-based holder device for crayons of different colors, the holder device comprising:

a plurality of crayons of different colors;

a main body sized to be positioned about and fit a child's forearm, wherein the main body forms a single continuous loop and is elastic, wherein the single continuous loop is sized to be slipped over the child's hand and onto the child's forearm;

a plurality of holder locations positioned about an outer circumference of the main body, each of the holder locations forming a loop with an opening being sized to hold at least one of the plurality of crayons;

an anchor coupled to the main body, the anchor forming an anchor loop;

a single attachment ring positioned through the anchor loop of the anchor to couple the single attachment ring to the main body; and a plurality of tethers for the plurality of crayons, each tether including:

a first end coupled to the single attachment ring that is looped through the main body; and a second end formed as an integral part of a respective crayon of the plurality of crayons;

wherein at least one respective tether is elastic so that the respective tether is stretchable to reach the child's hand when the respective crayon of the plurality of crayons that is coupled to the respective tether is being used.

2. The holder device of claim 1, wherein each of the holder locations is elastic to grip the plurality of crayons when positioned therein.

3. The holder device of claim 1, wherein the holder locations are positioned about only a portion of the outer circumference of the main body.

4. The holder device of claim 1, wherein the holder locations extend lengthwise in a general direction of the child's forearm.

* * * * *